US009182773B2

(12) United States Patent
Campean

(10) Patent No.: US 9,182,773 B2
(45) Date of Patent: Nov. 10, 2015

(54) LOW PROFILE AUTO-LOCKING PINCH/TURN ADJUSTMENT KNOB

(71) Applicant: Leupold & Stevens, Inc., Beaverton, OR (US)

(72) Inventor: Daniel I. Campean, Portland, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 14/153,949

(22) Filed: Jan. 13, 2014

(65) Prior Publication Data

US 2014/0196351 A1 Jul. 17, 2014

Related U.S. Application Data

(60) Provisional application No. 61/752,418, filed on Jan. 14, 2013.

(51) Int. Cl.
*F41G 1/38* (2006.01)
*G05G 1/08* (2006.01)

(52) U.S. Cl.
CPC *G05G 1/082* (2013.01); *F41G 1/38* (2013.01); *Y10T 74/20474* (2015.01)

(58) Field of Classification Search
CPC ..... F41G 1/38; F41G 1/3935; G05G 1/082; Y10T 74/20474
USPC ..... 42/119, 122, 125; 359/429, 426; 74/813 L, 504
See application file for complete search history.

(56) References Cited

U.S. PATENT DOCUMENTS

| | | | |
|---|---|---|---|
| 1,344,973 | A | 6/1920 | Bader |
| 2,143,167 | A | 1/1939 | Pechar |
| 2,165,796 | A | 7/1939 | Humeston |
| 2,208,913 | A | 7/1940 | Unertl |
| 2,229,637 | A | 1/1941 | Burton |
| 2,336,107 | A | 12/1943 | Litschert |

(Continued)

FOREIGN PATENT DOCUMENTS

| | | |
|---|---|---|
| CN | 2752794 Y | 1/2006 |
| DE | 2 148 967 | 4/1973 |

(Continued)

OTHER PUBLICATIONS

Notice of Allowance, U.S. Appl. No. 12/938,981, mailed Aug. 27, 2015, and Amendment and Response to Office Action (with Listing of Claims, as allowed), 16 pp.

*Primary Examiner* — Samir Abdosh
*Assistant Examiner* — John D Cooper
(74) *Attorney, Agent, or Firm* — Stoel Rives LLP

(57) ABSTRACT

A compact adjustment knob for an optical, mechanical, or electronic device includes a spindle supported on the device for rotation about an axis to control a setting of the device, and a releasable automatically locking lock mechanism supported on the spindle for rotation therewith. The lock mechanism includes at least one manually depressible button accessible on an outer surface of the adjustment knob and connected to an actuator shaft that extends inwardly through a drive hole in an outer side wall of the spindle so that a force manually applied to the button is transmitted by the actuator shaft to drive the lock mechanism and rotate the spindle. The lock mechanism may include a lock sleeve that is biased to a normally locked position and driven along the axis by the actuator shaft when the button is depressed.

15 Claims, 6 Drawing Sheets

(56) References Cited

U.S. PATENT DOCUMENTS

| | | | |
|---|---|---|---|
| 2,452,592 | A | 11/1948 | Meyer |
| 2,583,042 | A | 1/1952 | Dayton |
| 2,585,933 | A | 2/1952 | Harvey |
| 2,682,707 | A | 7/1954 | Folke |
| 2,913,826 | A | 11/1959 | Petty |
| 3,037,287 | A | 6/1962 | Glatz et al. |
| 3,058,391 | A | 10/1962 | Leupold |
| 3,161,716 | A | 12/1964 | Burris et al. |
| 3,206,238 | A | 9/1965 | Speight et al. |
| 3,222,987 | A | 12/1965 | Wrigglesworth |
| 3,280,463 | A | 10/1966 | Stadler |
| 3,297,389 | A | 1/1967 | Gibson |
| 3,471,932 | A | 10/1969 | Luning |
| 3,662,618 | A | 5/1972 | Kroll et al. |
| 3,707,204 | A | 12/1972 | Dussardier |
| 3,826,012 | A | 7/1974 | Pachmayr |
| 3,916,721 | A | 11/1975 | Egger |
| 3,990,155 | A | 11/1976 | Akin, Jr. et al. |
| 3,999,442 | A | 12/1976 | Decker et al. |
| 4,012,966 | A | 3/1977 | Lieberman et al. |
| 4,026,397 | A | 5/1977 | Raus |
| 4,038,757 | A | 8/1977 | Hicks et al. |
| 4,132,129 | A | 1/1979 | Pratt |
| 4,154,125 | A | 5/1979 | Frank |
| 4,200,355 | A | 4/1980 | Williams, Jr. |
| 4,201,096 | A | 5/1980 | Morrison et al. |
| 4,347,758 | A | 9/1982 | Geil et al. |
| 4,373,269 | A | 2/1983 | Doliber et al. |
| 4,389,791 | A | 6/1983 | Ackerman |
| 4,397,107 | A | 8/1983 | Holden |
| 4,408,842 | A | 10/1983 | Gibson |
| 4,457,076 | A | 7/1984 | Heck |
| 4,461,330 | A | 7/1984 | Judkins |
| 4,643,542 | A | 2/1987 | Gibson |
| 4,779,305 | A | 10/1988 | Gorsek |
| 4,955,253 | A | 9/1990 | Sakai et al. |
| 4,982,502 | A | 1/1991 | Weyrauch |
| 5,020,389 | A | 6/1991 | Sigler |
| 5,083,477 | A | 1/1992 | Geil |
| 5,121,653 | A | 6/1992 | Sigler |
| 5,152,187 | A | 10/1992 | LaFemina |
| 5,329,829 | A | 7/1994 | Sell |
| 5,363,559 | A | 11/1994 | McCarty |
| 5,433,010 | A | 7/1995 | Bell |
| 5,499,456 | A | 3/1996 | Tomita |
| 5,513,440 | A | 5/1996 | Murg |
| 5,586,569 | A | 12/1996 | Hanning et al. |
| 5,615,487 | A | 4/1997 | Tomita |
| 5,618,374 | A | 4/1997 | Byerley |
| 5,695,125 | A | 12/1997 | Kumar |
| 5,715,607 | A | 2/1998 | Murg |
| 5,745,287 | A | 4/1998 | Sauter |
| 5,771,595 | A | 6/1998 | Bell |
| 5,862,715 | A | 1/1999 | Lemire |
| 5,892,617 | A | 4/1999 | Wallace |
| 5,906,141 | A | 5/1999 | Abdelmoula |
| 5,930,934 | A | 8/1999 | Fisher et al. |
| 6,005,711 | A | 12/1999 | Mai et al. |
| 6,279,259 | B1 | 8/2001 | Otteman |
| 6,351,907 | B1 | 3/2002 | Otteman |
| 6,442,854 | B1 | 9/2002 | Liu et al. |
| 6,508,144 | B1 | 1/2003 | Vendetti et al. |
| 6,519,890 | B1 | 2/2003 | Otteman |
| 6,588,125 | B2 | 7/2003 | Proctor, Sr. |
| 6,643,970 | B2 | 11/2003 | Huber |
| 6,691,447 | B1 | 2/2004 | Otteman |
| 6,705,037 | B2 | 3/2004 | Van Kirk |
| 6,721,095 | B2 | 4/2004 | Huber |
| 6,772,550 | B1 | 8/2004 | Leatherwood |
| 6,848,628 | B2 | 2/2005 | Walker |
| 6,860,442 | B2 | 3/2005 | Datcuk, Jr. |
| 6,862,832 | B2 | 3/2005 | Barrett |
| 7,117,624 | B2 | 10/2006 | Kim |
| 7,121,037 | B2 | 10/2006 | Penney |
| 7,330,310 | B2 | 2/2008 | Hengst et al. |
| 7,640,830 | B2 | 1/2010 | Bonis |
| 8,006,429 | B2 | 8/2011 | Windauer |
| 8,270,104 | B2 | 9/2012 | Windauer |
| 2003/0140545 | A1 | 7/2003 | Huber |
| 2004/0088898 | A1 | 5/2004 | Barrett |
| 2006/0254115 | A1 | 11/2006 | Thomas et al. |
| 2006/0268433 | A1 | 11/2006 | Thomas |
| 2006/0278035 | A1 | 12/2006 | Casas |
| 2007/0240356 | A1 | 10/2007 | Klepp et al. |
| 2008/0066364 | A1 | 3/2008 | Klepp et al. |
| 2008/0197642 | A1 | 8/2008 | Talpe |
| 2008/0236018 | A1* | 10/2008 | Halverson ..... 42/135 |
| 2009/0205461 | A1 | 8/2009 | Windauer |
| 2011/0100152 | A1* | 5/2011 | Huynh ..... 74/504 |
| 2013/0167425 | A1 | 7/2013 | Crispin |
| 2013/0220060 | A1 | 8/2013 | Sano et al. |

FOREIGN PATENT DOCUMENTS

| | | | |
|---|---|---|---|
| DE | 297 20 737 | U1 | 2/1998 |
| DE | 299 03 989 | U1 | 6/1999 |
| DE | 20301749 | U1 | 4/2003 |
| DE | 102 22 528 | A1 | 12/2003 |
| DE | 202006003770 | U1 | 7/2006 |
| GB | 598306 | | 2/1948 |
| GB | 708438 | | 5/1954 |
| GB | 1102022 | | 2/1968 |
| GB | 1214584 | | 12/1970 |
| GB | 2213959 | A | 8/1989 |
| JP | 11-085290 | A | 3/1999 |
| WO | WO 2006/060490 | A2 | 6/2006 |
| WO | WO 2006/109587 | A1 | 10/2006 |

* cited by examiner

LOW PROFILE AUTO-LOCKING PINCH/TURN ADJUSTMENT KNOB

RELATED APPLICATION

This application claims priority to and the benefit under 35 U.S.C. §119(e) of U.S. Provisional Patent Application No. 61/752,418, filed Jan. 14, 2013, which is incorporated herein by reference.

TECHNICAL FIELD

The field of the present disclosure relates to automatically locking (auto-locking) rotatable adjustment knobs used to adjust a setting of a device such as a riflescope or other optical device, an electronic device, or a mechanical device.

BACKGROUND

Rotatable adjustment knobs or control knobs are commonly utilized to adjust settings of optical, mechanical, and electrical devices. Riflescopes and similar weapon aiming devices commonly include a pair of orthogonally mounted rotatable adjustment knobs, also known as turret knobs or simply turrets, which are used for adjusting elevation and windage settings affecting the respective vertical and horizontal aim of the riflescope, and thus of the weapon to which the riflescope is attached. Rotating adjustment knobs are also commonly used on riflescopes and other optical devices for adjusting focus, reticle illumination intensity, display settings, display illumination, and other settings of the device. Rotating adjustment knobs are also used on various other optical, electronic, and mechanical devices, such as spotting scopes, binoculars, microscopes, stereos and radios, appliances, automobile controls, and measurement instruments, for example.

In some applications, it is advantageous for an adjustment knob to automatically lock in place to prevent inadvertent adjustment. U.S. Pat. No. 8,006,429, issued Aug. 30, 2011, describes various locking turret knobs for riflescopes, some of which are normally locked, but may be unlocked by applying a releasing force to the knob or a component thereof, then rotating the knob to make an adjustment. In some embodiments described in the '429 patent, when the manual force is removed a spring or other biasing device of the knob automatically returns the locking mechanism to its normally locked state, preventing inadvertent rotation of the adjustment knob, for example during transit or other handling.

Patent Application Publication No. US 2011/0100152 A1 describes an auto-locking adjustment mechanism including a pair of buttons on opposite sides that are manually depressed with a pinching action to release the locking mechanism and allow the knob to be rotated for adjustment of a setting of a riflescope or other device. When force is released from the buttons, the device automatically locks. Hence, the adjustment mechanism is sometimes referred to as a pinch-and-turn adjustment knob or a pinch/turn knob. The buttons are carried by a knob body that is installed over and frictionally secured to a threaded spindle of the device by a pair of set screws. The knob carries an indicator ring marked to provide a visual indication of the rotational position of the knob relative to the riflescope. The zero position of the knob can be adjusted relative to the spindle by loosening the set screws, rotating the knob until a zero marking on the indicator ring is aligned as desired relative to the riflescope main tube, then re-tightening the set screws. Each of the buttons carries an actuator shaft that extends radially through a bore in the side of the knob body and operatively engages a linkage within the mechanism that is driven in an axial direction when the buttons are depressed to release the locking mechanism, allowing the knob body and spindle to be rotated together to drive a threaded adjustment screw plunger or another type of adjustment device.

The present inventor has recognized a need for an improved auto-locking pinch/turn adjustment knob.

SUMMARY

An adjustment knob for adjusting an optical, mechanical, or electronic device, includes a spindle supported on the device for rotation about an axis and a releasable lock mechanism supported on the spindle for rotation therewith. The spindle is operatively associated with an adjustment mechanism that controls a setting of the device. The lock mechanism includes a button that is manually depressible in a generally radial direction from a radially outward locked position at which the lock mechanism constrains the spindle to prevent it from rotating relative to the device, to a radially inward unlocked position that releases the lock mechanism and allows the spindle to be rotated. The lock mechanism also includes an actuator shaft connected to the button and extending radially inward through a drive hole in an outer side wall of the spindle. A force applied to the button drives the lock mechanism and is transmitted to the spindle via the actuator shafts to rotate the spindle. A hermetic seal may be provided between the actuator shaft and the drive hole, which also provides a sliding interface therebetween. The spindle and its outer side wall, including the drive hole, are preferably formed in a monolithic structure for rigidity and sealing purposes, among others. Accordingly, the spindle may be driven for rotation by forces transmitted directly from the button to the spindle primarily via engagement of the actuator shaft in the drive hole.

The lock mechanism may include a lock sleeve having a tapered surface that is contacted by the actuator shaft and thereby driven along the axis by the actuator shaft when the button is depressed. The lock sleeve may be positioned in an annular groove of the spindle and is preferably biased in the axial direction toward the locked position by a spring that is operably interposed between the lock sleeve and the spindle and concentric with the axis. The lock sleeve is driven in opposition to the spring force toward the unlocked position by depressing the button. The spring preferably has sufficient biasing force to return the lock sleeve and the button to the locked position when external force is released from the button. The lock mechanism may further include a lock pin carried by the spindle, which is contacted by the lock sleeve and driven radially outward by movement of the lock sleeve and into engagement with a catch when the lock sleeve is in the locked position.

The adjustment mechanism may include a threaded adjustment plunger such as an adjustment screw threaded into the spindle and constrained to prevent it from rotating about the axis, or may include a different kind of adjustment mechanism, such as an orbital pin, crown gear arrangement, spiral cam mechanism, etc. The lock sleeve may encircle the threaded adjustment plunger or screw.

The adjustment knob may further comprise a revolution indicator pin attached to the adjustment screw for movement therewith along the axis and visible from outside of the adjustment knob to provide a visual indication of the number of revolutions that the spindle is turned relative to an initial zero position.

The adjustment knob may also include a second lock-release button and second actuator shaft supported on the outer side wall of the spindle opposite the button so that the button and the second button may be pinched toward each other by a user to unlock the lock mechanism.

DETAILED DESCRIPTION OF PREFERRED EMBODIMENTS

Figure 1:
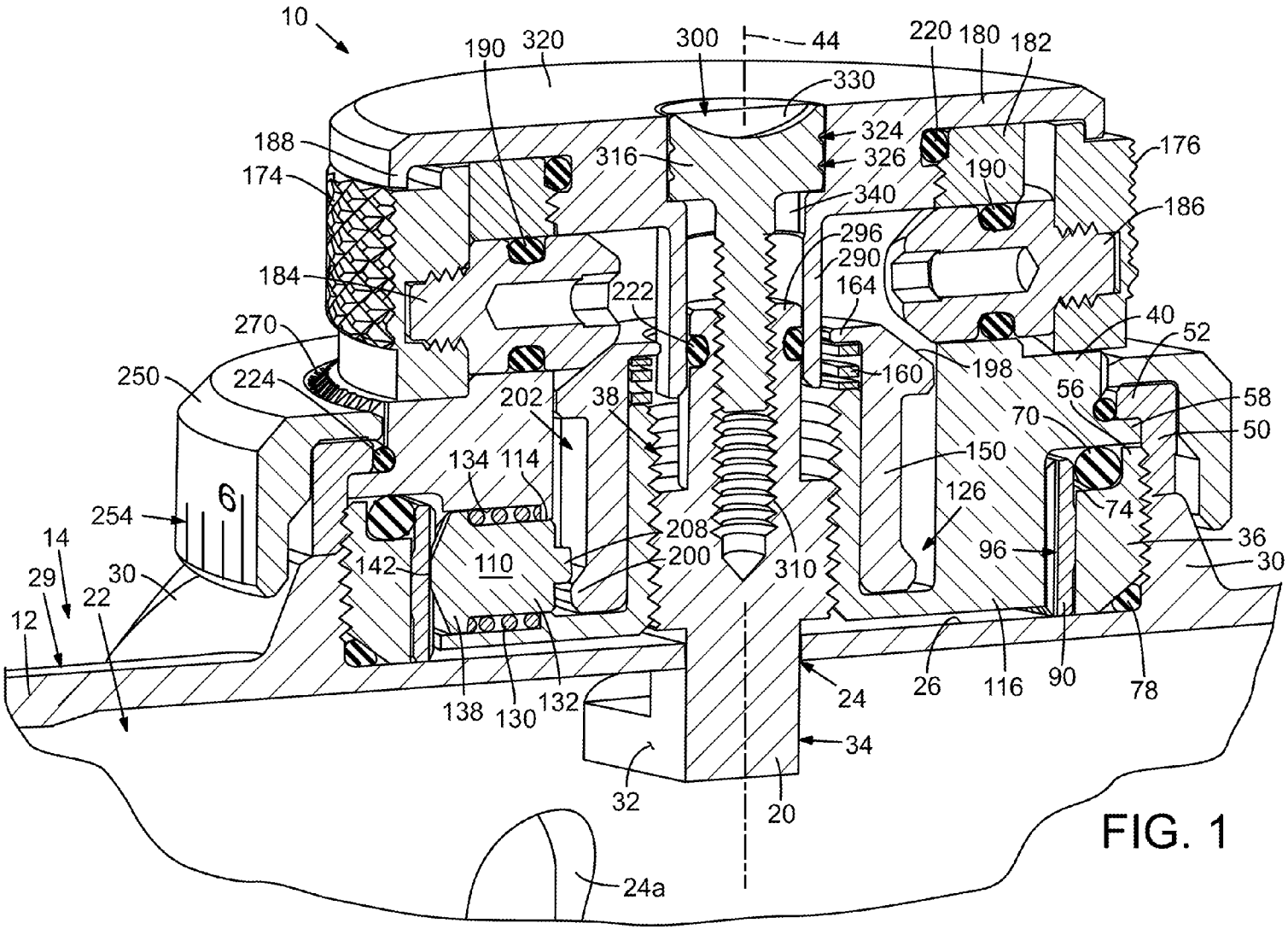
FIG. 1 is an isometric cross sectional view of an auto-locking adjustment knob shown installed on a riflescope illustrated in partial cross section.

FIG. 1. is an isometric cross sectional view of an auto-locking pinch/turn adjustment knob 10 in accordance with a presently preferred embodiment, illustrated as an elevation control knob mounted on a housing (main tube 12) of a riflescope 14. Riflescope 14 is merely exemplary of a type of optical aiming device with which adjustment knob 10 may be utilized. Other devices with which adjustment knob 10 may be used are noted elsewhere herein.

Figure 2:
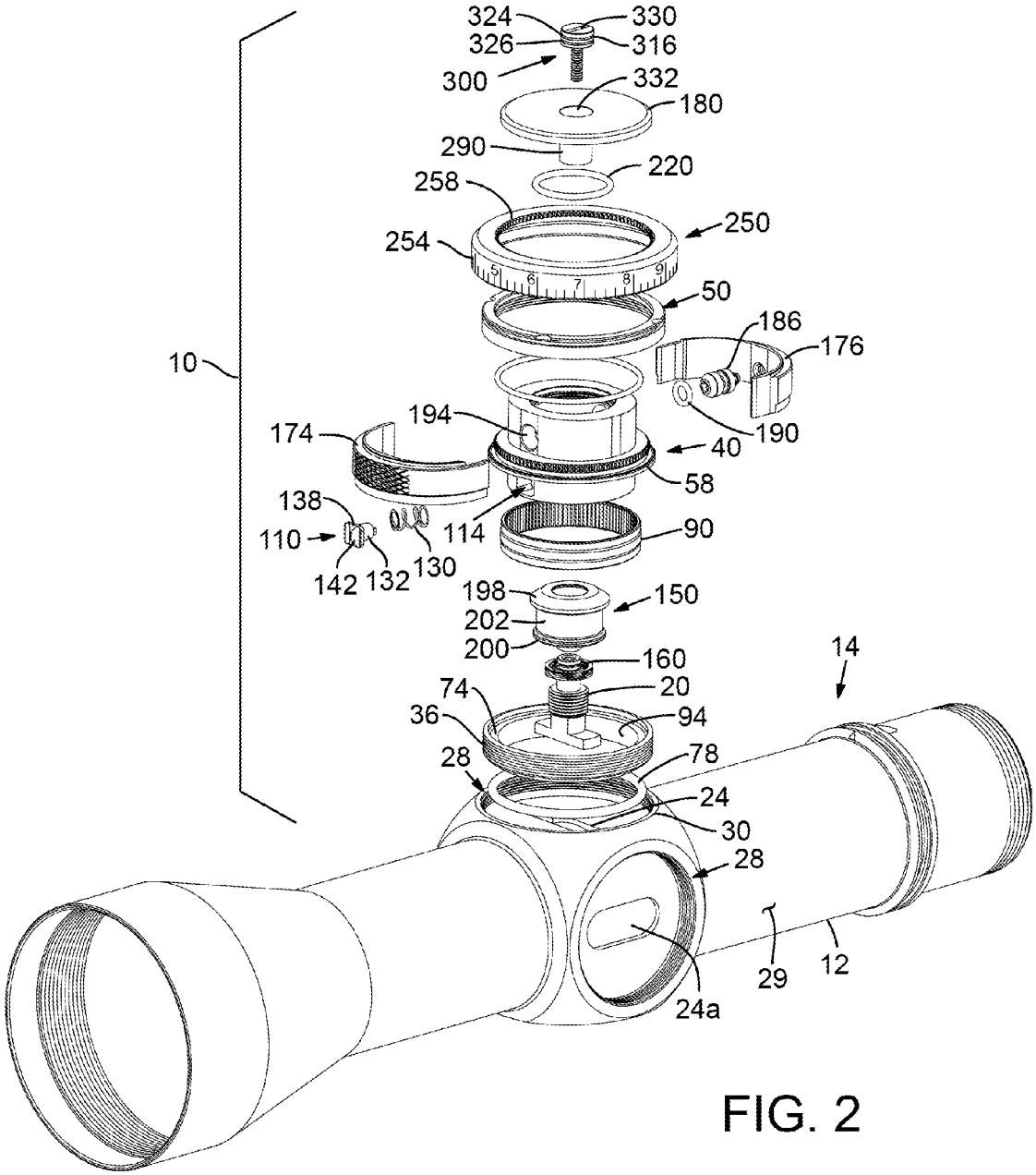
FIG. 2 is an exploded assembly view showing the adjustment knob and a riflescope housing of FIG. 1.

With reference to FIG. 1, adjustment knob 10 includes a threaded adjustment plunger in the form of an adjustment screw 20 extending into an interior 22 of riflescope 14 via a slot 24 (best shown in FIG. 2 along with a similar second slot 24*a* for a windage adjustment screw). Slot 24 is formed in a floor 26 of a turret seat 28 (FIG. 2) that is formed on a lateral outer surface 29 of main tube 12. Flats 32, 34 on the sides of an inner end of adjustment screw 20 prevent adjustment screw 20 from rotating relative to main tube 12. Turret seat 28 includes a threaded mounting boss 30 into which a threaded adapter ring 36 is fitted. Adjustment screw 20 is threaded into a threaded bore 38 of a spindle 40 that is retained in turret seat 28 for rotation about an axis 44 of adjustment knob 10 as further described below. When spindle 40 is rotated, the rotatably constrained adjustment screw 20 is driven along axis 44 to adjust a setting of riflescope 14, for example by bearing against and moving an erector lens holder tube (not shown) that may be disposed within and pivotably mounted to main tube 12, and spring-biased to press against the inner end of adjustment screw 20. In an alternative embodiment (not illustrated), instead of adjustment screw 20, the threaded adjustment plunger may comprise an internally threaded post or standoff having a threaded end portion for mounting to an externally threaded portion of a spindle.

A retainer nut 50 having an inwardly extending lip 52 is threaded onto an axially outer end 56 of adapter ring 36 that extends beyond mounting boss 30 to retain spindle 40 in turret seat 28. A flange 58 of spindle 40 is captured between lip 52 and the axially outer end 56 of adapter ring 36. Retainer nut 50 is sized to provide clearance around flange 58, allowing smooth rotation of spindle 40. An o-ring 70 or sliding gasket made of a resilient material is positioned in a groove or step 74 formed in outer end 56 of adapter ring 36 and is sized to project beyond outer end 56 to provide a bearing surface for spindle 40, while also providing a hermetic seal between spindle 40 and adapter ring 36. A second sealing gasket or o-ring 78 is positioned between adapter ring 36 and turret seat 28. In the embodiment illustrated, adapter ring 36 is provided on a standard mounting boss 30 design (which may fit many different styles of adjustment knobs) to retrofit the mounting boss 30 for the particular mounting requirements of adjustment knob 20. In other embodiments (not shown), adapter ring 36 may be omitted, and retainer nut 50 may be threaded directly onto main tube 12.

Although the preferred embodiment is described herein as an adjustment screw device for a riflescope, embodiments of the pinch/turn adjustment knob described herein may be utilized with adjustment mechanisms other than adjustment screws, such as other mechanical devices, electrical controls, and other mechanisms. For example, instead of a threaded adjustment plunger, the adjustment mechanism may comprise an eccentric pin or spiral cam mechanism of the kind described in U.S. Pat. No. 6,351,907, issued Mar. 5, 2002, a crown gear mechanism, taut-band mechanism, or other mechanical device. Alternatively, the adjustment knob may rotate an electrical control comprising a rheostat or an arrangement of electrical contact pads that are selectively brought into contact with electrical contacts depending on the position of the control knob.

Figure 3:
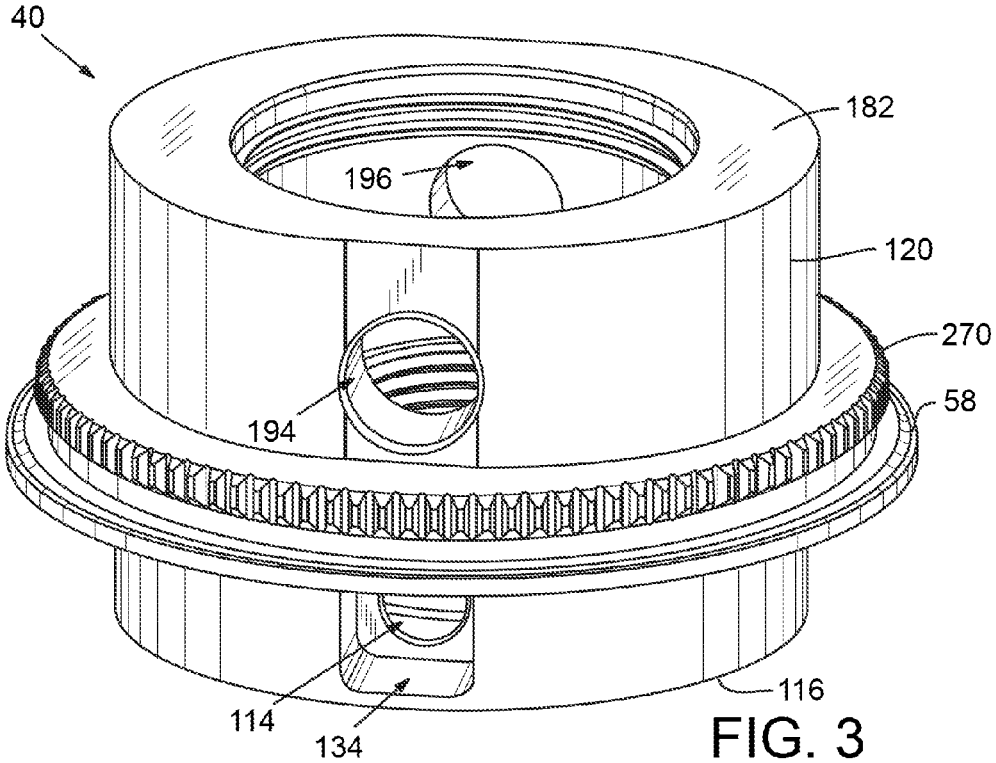
FIG. 3 is an enlarged isometric view of a spindle of the adjustment knob of FIG. 1.
Figure 4:
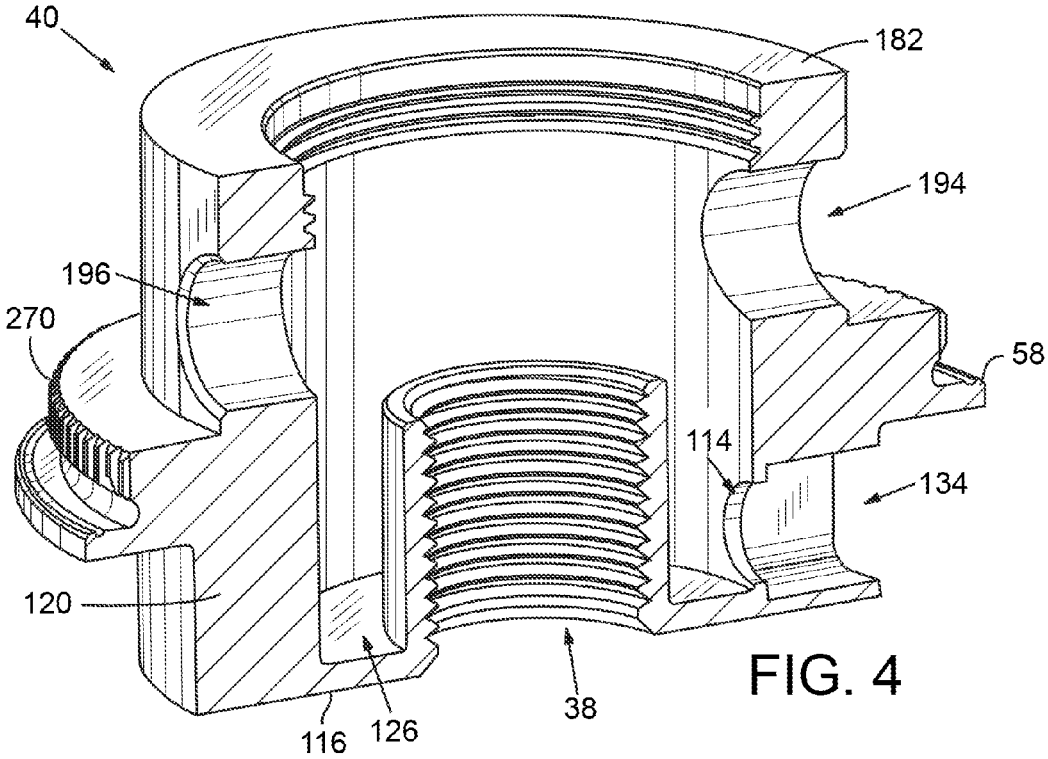
FIG. 4 is an isometric cross sectional view of the spindle of FIG. 3.
Figure 5:
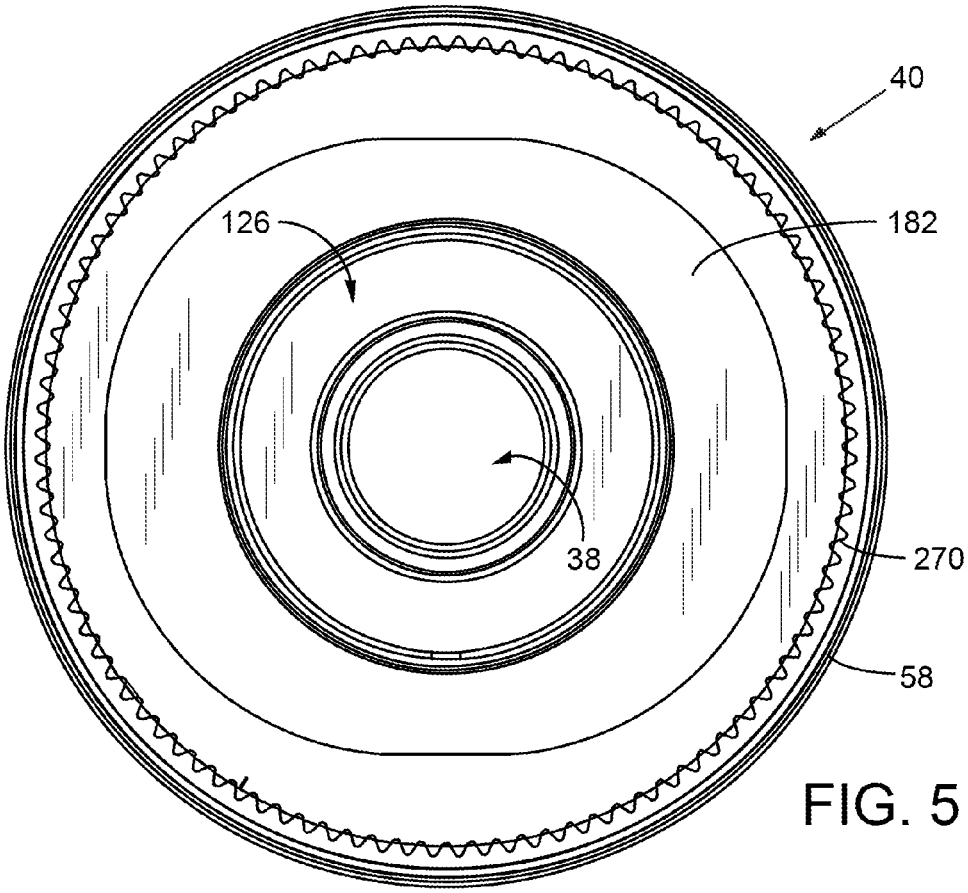
FIG. 5 is top view of the spindle of FIG. 3.
Figure 6:
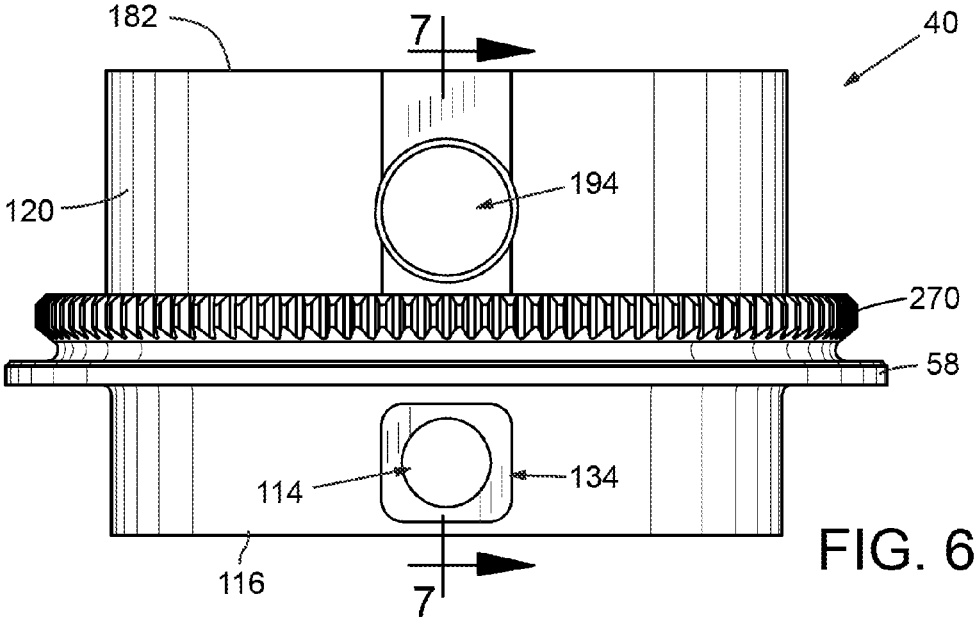
FIG. 6 is a side view of the spindle of FIGS. 3 and 5.
Figure 7:
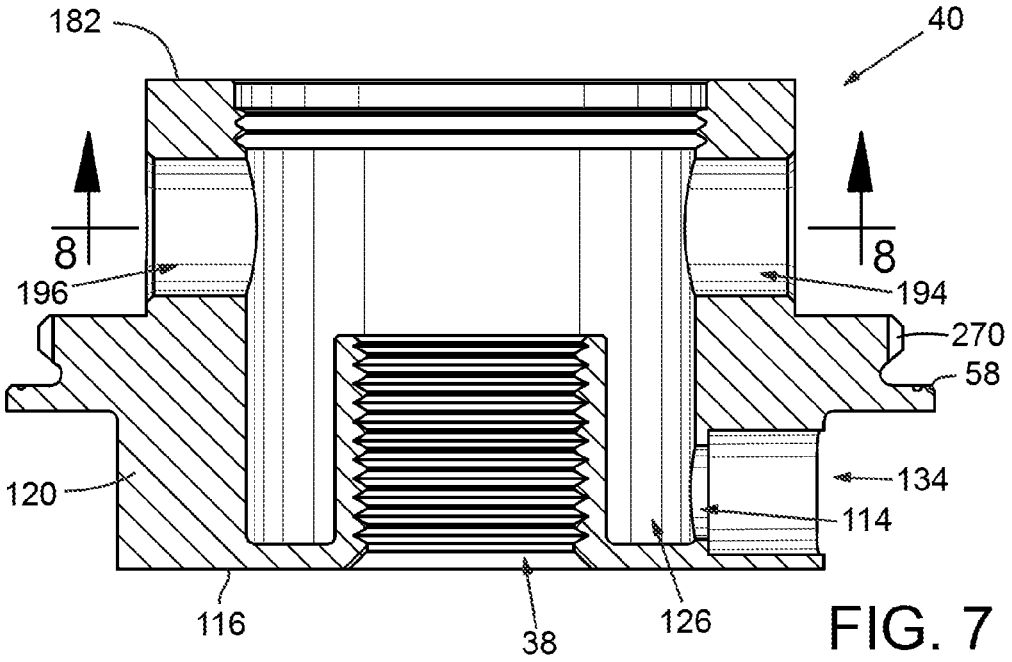
FIG. 7 is a cross sectional view taken along lines 7-7 of FIG. 6.
Figure 8:
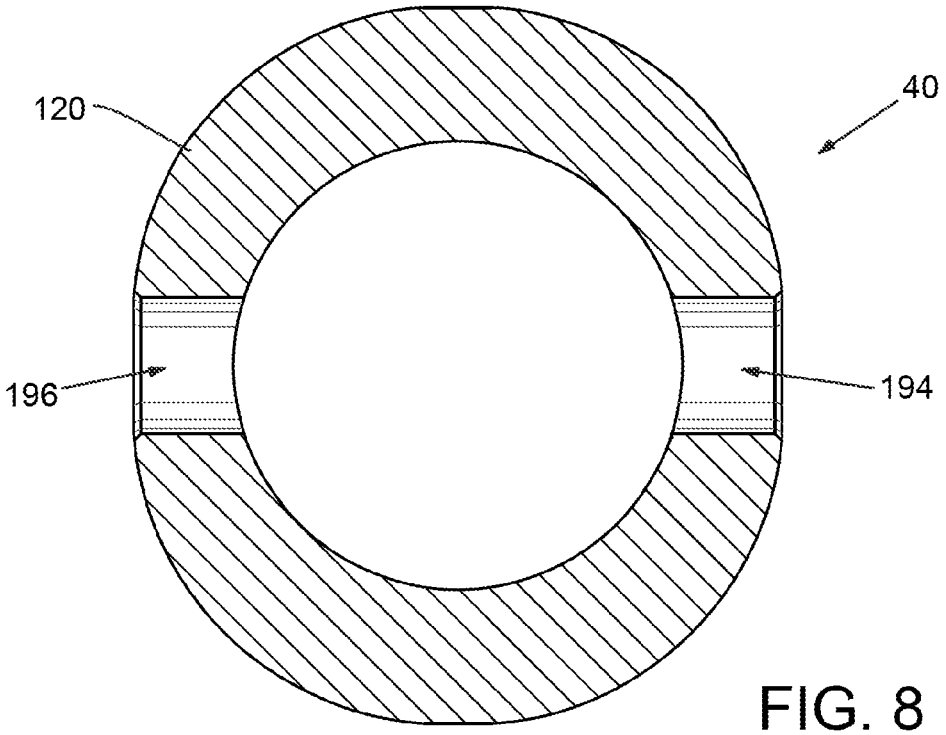
FIG. 8 is a cross sectional view taken along lines 8-8 of FIG. 7.

Turning back to the preferred embodiment of FIG. 1, a detent ring 90 is press-fit or cemented to an inner face 94 (FIG. 2) of adapter ring 36 and bears a series of catch structures, for example evenly spaced alternating axially extending ridges and grooves (detent grooves 96), formed along an inner surface of detent ring 90. In an alternative embodiment (not illustrated), detent ring 90 may be omitted in favor of detent grooves 96 or other catch structures formed directly in the surface of adapter ring 36 or, if adapter ring 36 is omitted as suggested above, in an inner circumferential surface of mounting boss 30. A lock pin 110 is slidably mounted in a radial bore 114 formed in spindle 40 near its base 116. FIGS. 3 and 4 are respective isometric and cross sectional views of spindle 40 showing detail of bore 114 and other aspects of spindle 40. FIGS. 5-8 illustrate additional views of spindle 40. With reference to FIGS. 1, 3, and 4-8, bore 114 extends through an outer wall 120 of spindle 40 into an annular groove 126 (FIG. 4) that is coaxially aligned with spindle 40 (on axis 44). Spindle 40 and its outer side wall 120, including bore 114, annular groove 126, drive holes 194, 196, and other features illustrated in FIGS. 5-8, are preferably formed in a monolithic structure to provide rigidity or improved sealing, or for other reasons. A coil spring 130 encircling a neck portion 132 of lock pin 110 is captured in a pocket 134 leading to bore 114, and is compressed to bear against a head 138 of lock pin 110 and a bottom of the pocket 134 to urge lock pin 110 radially outward against detent ring 90 and into detent grooves 96.

FIG. 2 shows how the outer end 142 of head 138 is wedge-shaped to allow it to ride over the ridges and grooves 96 (FIG. 1) of detent ring 90 during rotation of adjustment knob 10 to provide tactile and/or auditory feedback of clicks indicating a predetermined amount of adjustment. In one embodiment, detent ring 90 includes one hundred (100) regularly spaced detent grooves 96 circumscribing detent ring 90, and the pitch of adjustment screw 20 is selected so that each click represents approximately 0.1 milliradian (mils) of elevation or windage adjustment. In other embodiments a greater or lesser number of detent grooves 96 may be provided and the pitch of adjustment screw 20 may be different.

With reference again to FIG. 1, an annular lock sleeve 150 surrounds adjustment screw 20 and is retained in annular groove 126 of spindle 40 in operative engagement with lock pin 110. A lock spring 160 captured between an inner lip 164 of lock sleeve 150 and spindle 40 is operably interposed therebetween to urge spindle 40 axially outward along axis 44. A pair of release buttons 174, 176 are supported adjacent opposite sides of spindle 40 where they are exposed and can be manipulated and operated from outside adjustment knob 10 by grasping or pressing them via a user's fingers. Release buttons 174, 176 are retained on spindle 40 by a cap 180 that is threadably secured to spindle 40 over an axially outer end 182 thereof. First and second actuator shafts 184, 186 are mounted to and extend radially inward from buttons 174, 176 through drive holes 194, 196 (FIG. 3) formed in outer wall 120 of spindle 40. A skirt portion 188 of cap 180 extends axially from a peripheral edge of cap 180 to retain buttons 174, 176. Actuator shafts 184, 186 are each fitted with o-rings 190, providing a hermetic seal and sliding interface between actuator shafts 184, 186 and drive holes 194, 196. Actuator shafts 184, 186 have radiused tips that engage a tapered shoulder surface 198 of lock sleeve 150 when release buttons 174, 176 are depressed. First release button 174 and actuator shaft 184 are shown in FIG. 1 in their depressed (unlocked) position, whereat the inner end of actuator shaft 184 bears against shoulder surface 198 to drive lock sleeve 150 axially inward to its unlocked position in opposition to the biasing force of lock spring 160. In the unlocked position, a foot portion 200 of lock sleeve 150 is moved axially inward and a channel 202 on an outer surface of lock sleeve 150 between foot portion 200 and shoulder surface 198 is aligned with a heel 208 of lock pin 110, providing clearance that allows lock pin 110 to reciprocate within bore 114 for providing tactile and audible feedback to the user as adjustment knob 10 is turned.

In an alternative embodiment (not illustrated), the lock sleeve 150 may instead be biased in an inward direction, and configured and interfaced with the actuator shafts 184, 186 and lock pin 110 so that when the release buttons are depressed the actuator shafts drive the lock sleeve in an axially outward direction to unlock the adjustment knob.

Second release button 176 and actuator shaft 186 are shown in FIG. 1 in the locked (undepressed) position (although the lock sleeve 150 is shown in the unlocked position by virtue of the first release button 174 being depressed). When manual pinching force is removed from both release buttons 174 and 176 they return to the locked position by virtue of the biasing force provided by lock spring 160 driving lock sleeve 150 axially outward. In the locked condition, the foot portion 200 of lock sleeve 150 presses against heel 208 of lock pin 110 to drive lock pin 110 radially outward and securely seat outer end 142 in one of the detent grooves 96, which locks adjustment knob 10 to prevent it from being inadvertently rotated about axis 44.

O-rings 74, 78, 190, and additional seals or o-rings 220, 222, are provided at interfaces between parts of adjustment knob 10 to hermetically seal main tube 12 and retain a dry gas charge therein to prevent weather-induced condensation on internal optical elements (not shown) of riflescope 14. A further o-ring 224 is provided along an outer surface of flange 58 of spindle 40 to help center spindle 40 on axis 44, and to prevent dust and grit from migrating into the sliding bearing between flange 58, retainer nut 50, and adapter ring 36.

The design of adjustment knob 10 is greatly simplified relative to the device disclosed in US 2011/0100152, reducing component cost and assembly expense, and further providing certain advantages. The shape of lock sleeve 150 enables it to extend into annular groove 126 in spindle 40 and directly engage lock pin 110, thereby eliminating a lock pin linkage of prior designs. The shape of lock sleeve 150 also enables the use of concentric lock spring 160, which provides a centered biasing force that may be sufficient for returning release buttons 174, 176 to the locked position, thereby eliminating the need for separate button return springs of prior designs. Alternatively, a second return spring or set of springs (not illustrated) may be provided to act directly on buttons 174, 176 and/or actuator shafts 184. For example, a leaf spring or spring loop may be interposed between the tips of actuator shafts 184, 186 and extend around a stem 290 of cap 180 where there is space for the leaf spring or loop spring to flex when buttons 174, 176 are depressed.

Extending the actuator shafts 184, 186 through drive holes 194, 196 in spindle 40 eliminates the need for a separate button-carrying knob body of prior designs and the frictional connection between the button-carrying knob body and the spindle provided by a set screw of prior designs. Instead, the actuator shafts 184, 186 and buttons 174, 176 are carried by drive holes 194, 196 of spindle 40, and directly drive spindle 40 for rotation about axis 44 without the need for a frictional connection that the inventors have found prone to slippage. Several of the above-described differences also cooperate to provide an adjustment knob 10 having an overall height above floor 26 of turret seat 28 (or above the lateral outer surface 29 of main tube 12) that is approximately half that of prior designs. In some embodiments, adjustment knob 10 has an overall height H above floor 26 in the range of approximately 0.55 inch to approximately 0.7 inch (approximately 14 to 18 mm). In other embodiments, adjustment knob 10 may have a height H in the range of 0.5 to 0.8 inch (12.7 to 20.3 mm), or in the range of 0.5 to 0.9 inch (12.7 to 22.9 mm), or in the range of 0.5 to 1.0 inch (12.7 to 25.4 mm). This low-profile design is advantageous for use with riflescopes, as it avoids obscuring the shooter's view past the outside of the riflescope and may facilitate the use of auxiliary aiming devices such as reflex sights that may be mounted alongside or closely above riflescope 14.

Figure 9:
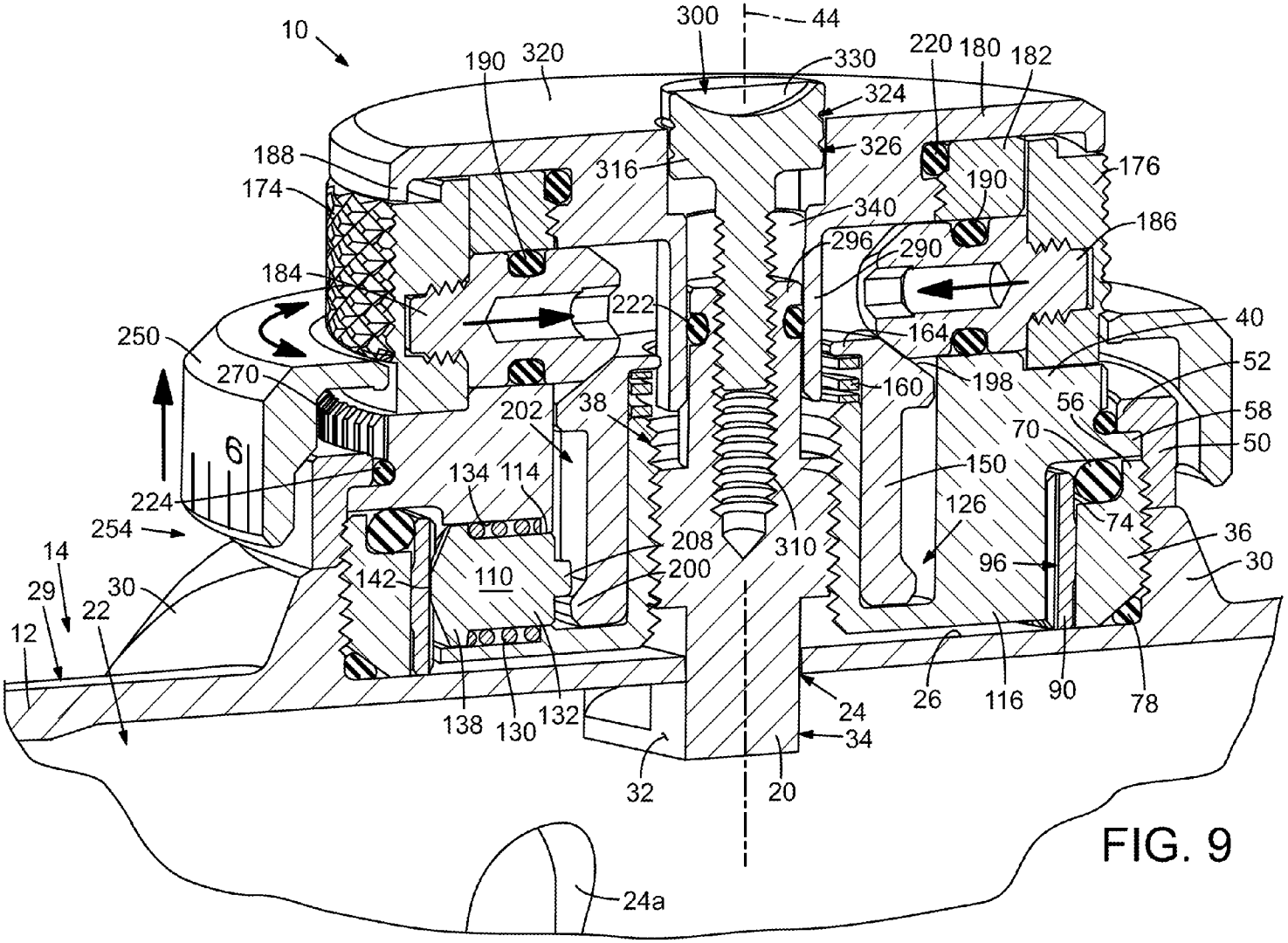
FIG. 9 is an auxiliary view of the adjustment knob of FIG. 1, illustrating a process for manually re-positioning or re-zeroing an indicator ring of the adjustment knob.

With reference to FIGS. 1, 2, and 9, an indicator ring 250 bearing a scale 254 or other indicia marked along an outer circumferential surface thereof is installed around adjustment knob 10 and over retainer nut 50. Indicator ring 250 includes a set of splines formed along an inner shoulder opening 258 (FIG. 2) of indicator ring 250. The splines of indicator ring 250 are sized to mesh with splines 270 (FIG. 3) formed around outer wall 120 of spindle 40 adjacent and axially outward of flange 58 so that indicator ring 250 rotates with spindle 40 relative to main tube 12. A fiduciary mark (not shown) on the outside of mounting boss 30 is visually referenced by a user to read the rotational position of adjustment knob 10 from scale 254.

Due to elimination of the adjustable frictional connection of prior designs between an outer knob body and a spindle, a different mode of re-zeroing adjustment knob 10 is provided in the present embodiment. The rotational position of indicator ring 250 is adjustable relative to spindle 40 for re-zeroing the indicator ring 250, for example after sighting-in riflescope 14. With particular reference to FIG. 9, to adjust the position of indicator ring 250, actuator buttons 274, 276 (which serve as a latch for retaining indicator ring 250) are depressed with one hand and indicator ring 250 is pulled axially outward around buttons 274, 276 with the other hand, then indicator ring 250 is rotated relative to spindle 40 and replaced axially onto splines 270. Indicator ring 250 may also be completely removed from adjustment knob 10 in the same two-handed manner by depressing buttons 274, 276 and sliding indicator ring 250 over buttons 274, 276, and subsequently replaced with an indicator ring having a different scale, such as a scale calibrated for a particular type of weapon and/or ammunition. Further details of adjustable replaceable indicator rings similar to ring 250 are provided in U.S. patent application Ser. No. 13/683,985, filed Nov. 21, 2012, which is incorporated herein by reference.

Turning again to FIG. 1, cap 180 includes a tubular central stem 290 extending axially inwardly around an outer end 296 of adjustment screw 20. O-ring 222 is fitted in a circumferential groove around outer end 296 of screw 20 to achieve hermetic seal therebetween. O-ring 222 facilitates sliding movement of screw 20 relative to cap 180 as adjustment knob 10 is adjusted. An optional threaded revolution indicator pin 300 is threaded into a threaded bore 310 in the outer end of adjustment screw 20. Revolution indicator pin 300 rides with adjustment screw 20 as adjustment knob 10 is adjusted so that a head 316 of revolution indicator pin 300 projects outwardly beyond an outer major surface 320 of cap 180 as adjustment screw 20 is adjusted. A pair of circumscribed indicator grooves 324, 326 or markings on head 316 indicate the number of revolutions that adjustment knob 10 has been turned. For example, when adjustment knob 10 has been turned a full revolution to achieve 10 milliradians of angular aiming adjustment the outermost groove 324 is visible slightly above with the outer major surface 320 of cap 180, as illustrated in FIG. 9, and when adjustment knob 10 has been rotated two revolutions to achieve an angular aiming adjustment of 20 milliradians the second groove 326 is visible slightly above outer major surface 320. Thus, visibility of none, one, or both of grooves 324, 236 indicates the number of revolutions of adjustment knob 10. In other embodiments (not illustrated), the revolution indicator pin 300 is omitted and the top of cap 180 is solid.

A slot 330 in the head of revolution indicator pin 300 is sized so that a tail of a cartridge or a small flathead screwdriver can be used to adjust a zero stop position by tightening revolution indicator pin 300 until head 316 is snugly seated in a counterbore 334 (FIG. 2) of cap 180 in the zero position shown in FIG. 1. The zero stop position enables adjustment knob 10 to be quickly returned to the zero position after an adjustment, without looking at revolution indicator pin 300. Also, during sighting-in of a weapon and riflescope 14, revolution indicator pin 300 may be loosened or removed to allow unrestricted travel of adjustment screw 20. After the weapon and riflescope 14 have been sighted in, revolution indicator pin 300 is replaced and tightened to set the zero stop point of adjustment knob 10. After subsequent adjustments of adjustment knob 10 (e.g., elevation adjustment for longer range shots), adjustment knob 10 can be quickly returned to the zero stop position merely by rotating adjustment knob 10 in the opposite direction until it stops against head 316 of revolution indicator pin 300.

Completely removing revolution indicator pin 300 reveals a tool-receiving drive socket, such as a hex socket 340 within stem 290 that receives a tool (such as a hex key, not illustrated) for removing cap 180 and disassembling adjustment knob 10 for maintenance or replacement.

Except for o-rings 70, 78, 190, 220, 222, and 224 and springs 130 and 160, all components of adjustment knob 10 may be machined from solid aluminum, steel, or another metal. In some embodiments, lock sleeve 150, actuator shafts 184, 186, lock pin 110, and certain other friction and wear components may be polished and/or coated with a wear-resistant hard coating or made from a low-friction material for enhancing durability and reliability. Alternatively, some components may be made of plastic or another low-cost or low-friction material, albeit usually resulting in a less durable device.

It will be obvious to those having skill in the art that many changes may be made to the details of the above-described embodiments without departing from the underlying principles of the invention. The scope of the present invention should, therefore, be determined only by the following claims.

The invention claimed is:

1. An adjustment knob for adjusting an optical, mechanical, or electronic device, comprising:

a spindle supportable on the device for rotation about an axis, the spindle operatively associated with an adjustment mechanism that controls a setting of the device; and a releasable lock mechanism supported on the spindle for rotation therewith, the lock mechanism including:

a button manually depressible in a generally radial direction from a radially outward locked position at which the lock mechanism constrains the spindle to prevent it from rotating relative to the device, to a radially inward unlocked position that releases the lock mechanism and allows the spindle to be rotated, and an actuator shaft connected to the button and extending radially inward through a drive hole in an outer side wall of the spindle, the actuator shaft transmitting a force applied to the button to drive the lock mechanism and to rotate the spindle.

2. The adjustment knob of claim 1, wherein the adjustment mechanism includes an adjustment plunger threaded to the spindle and constrained to prevent the adjustment plunger from rotating about the axis.

3. The adjustment knob of claim 2, wherein the adjustment plunger is an adjustment screw, and further comprising a revolution indicator pin that is attached to the adjustment screw for movement therewith along the axis and visible from outside of the adjustment knob to provide a visual indication of the number of revolutions that the spindle is turned relative to an initial zero position.

4. The adjustment knob of claim 2, wherein the lock mechanism includes a lock sleeve encircling the adjustment plunger and driven by the actuator shaft for movement along the axis in response to a user depressing the button, to thereby release the lock mechanism.

5. The adjustment knob of claim 1, wherein the lock mechanism includes a lock sleeve that extends into an annular groove in the spindle.

6. The adjustment knob of claim 1, wherein the lock mechanism includes a lock sleeve that is biased in the axial direction toward the locked position by a spring that is concentric with the axis, and the lock sleeve is driven in opposition to the spring toward the unlocked position by depressing the button, and wherein the spring provides sufficient biasing to return the lock sleeve and the button to the locked position when the force is released from the button.

7. The adjustment knob of claim 1, wherein the lock mechanism includes a lock sleeve that is driven along the axis by the actuator shaft when the button is depressed.

8. The adjustment knob of claim 7, wherein the lock mechanism further includes a lock pin carried by the spindle, and the lock sleeve contacts and drives the lock pin radially outward and into engagement with a catch when the lock sleeve is in the locked position.

9. The adjustment knob of claim 7, wherein the actuator shaft contacts and slides against a tapered shoulder surface of the lock sleeve to drive the lock sleeve along the axis and release the lock mechanism.

10. The adjustment knob of claim 7, further comprising a lock spring operably interposed between the lock sleeve and the spindle to bias the lock sleeve along the axis toward the locked position.

11. The adjustment knob of claim 1, further comprising a hermetic seal between the actuator shaft and the drive hole that also provides a sliding interface therebetween.

12. The adjustment knob of claim 1, wherein the spindle and its outer side wall, including the drive hole, are formed in a monolithic structure.

13. The adjustment knob of claim 1, wherein the spindle is manually driven for rotation by forces transmitted from the button to the spindle primarily via engagement of the actuator shaft in the drive hole.

14. The adjustment knob of claim 1, further comprising a second lock-release button supported on the outer side wall of the spindle opposite the button so that the button and the second button may be pinched toward each other by a user to unlock the lock mechanism, the second lock-release button connected to a second actuator shaft that extends radially inward through a second drive hole in the outer side wall of the spindle opposite the drive hole, the second actuator shaft transmitting a force applied to the second button to drive the lock mechanism and to rotate the spindle.

15. An optical aiming device including the adjustment knob of claim 1.

* * * * *